US008651175B2

(12) United States Patent
Fallen

(10) Patent No.: US 8,651,175 B2
(45) Date of Patent: Feb. 18, 2014

(54) TOP DRIVE OUTPUT TORQUE MEASUREMENT METHOD

(75) Inventor: Matthew Fallen, Calgary (CA)

(73) Assignee: Tesco Corporation, Houston, TX (US)

( * ) Notice: Subject to any disclaimer, the term of this patent is extended or adjusted under 35 U.S.C. 154(b) by 411 days.

(21) Appl. No.: 13/007,293

(22) Filed: Jan. 14, 2011

(65) Prior Publication Data

US 2012/0181083 A1 Jul. 19, 2012

(51) Int. Cl.
*E21B 19/18* (2006.01)

(52) U.S. Cl.
USPC ..... 166/77.51; 175/40

(58) Field of Classification Search
USPC ..... 166/250.1, 77.51; 175/40; 73/761, 856, 73/862.045, 862.046
See application file for complete search history.

(56) References Cited

U.S. PATENT DOCUMENTS 5,433,279 A 7/1995 Tessari
6,212,976 B1 4/2001 Stogner
7,140,443 B2 11/2006 Beierbach
7,757,759 B2 * 7/2010 Jahn et al. ..... 166/250.01
2007/0209805 A1 9/2007 Angman
2007/0240908 A1 10/2007 Brown
2009/0266539 A1 10/2009 Ruark et al.

FOREIGN PATENT DOCUMENTS

WO 2007090034 A2 8/2007

OTHER PUBLICATIONS

Strainsert, "Clevis Pin Installation," found at www.strainsert.com, pp. 30-31.
International Search Report and Written Opinion (PCT/CA2012/000033), dated Apr. 24, 2012.

* cited by examiner

*Primary Examiner* — David Andrews
*Assistant Examiner* — Wei Wang
(74) *Attorney, Agent, or Firm* — Bracewell & Giuliani LLP

(57) ABSTRACT

A top drive assembly that includes a gauge for measuring strain in a linkage coupling the top drive to a drilling rig frame. The strain measuring gauge, which can be a strain gauge, is disposed on a pin that pivotingly links members of the linkage coupling. When a motor in the top drive assembly operates to rotate an associated pipe string, the torque generated by the motor can be estimated by monitoring strain measured in the pin.

16 Claims, 3 Drawing Sheets

TOP DRIVE OUTPUT TORQUE MEASUREMENT METHOD

FIELD OF THE INVENTION

This invention relates in general to forming a subterranean bore using drilling rig with a top drive, and in particular measuring a torque from the top drive. More specifically, the present invention relates to estimating top drive torque by monitoring strain within linkage elements coupling the top drive to a support.

DESCRIPTION OF RELATED ART

The most common way of drilling an oil or gas well involves attaching a drill bit to a string of drill pipe and rotating, the drill pipe to drill the well. A top drive can be used in a drilling rig for handling the string of drill pipe, also referred to as a pipe string, during drilling or casing a wellbore. In some well operations, an engaging apparatus, including an internal or external, pipe gripping mechanism, can be connected below the top drive to grip a joint of casing, so that the engaging apparatus and the joint of casing can be driven axially and/or rotationally by the top drive. In a drilling rig, the top drive can be hung in the mast with the engaging apparatus connected in drive communication and in substantial axial alignment therebelow. The top drive and engaging apparatus are hung in the mast above the well center and define a main axis of the drilling rig that is aligned with well center. The joints of casing, for connection into the casing or liner string, can be supported, for example in a V-door, adjacent the main axis of the drilling rig. For connection into the casing or liner string, the pipe joints can be engaged by an elevator and brought under the drive system for engagement and handling. Generally, the elevator is supported on link arms.

It is important to know how much torque is being generated by top drive, particularly during make-up of the threaded connections. One method of estimating torque monitors the electrical current or hydraulic power being used by the top drive during pipe make-up. This method is not very accurate. Another method mounts a sub in the drill string between the quill and pipe gripper, the sub having means for measuring torque output from the quill. However, the sub lengthens the distance between the top drive and the lower end of the pipe gripper.

SUMMARY OF THE INVENTION

Disclosed herein is a method and apparatus for estimating top drive torque generated during use. In one example embodiment of a method a top drive assembly is provided that has a motor for rotating a pipe, a torque restraint engageable with a rail portion of a drilling rig, and a linkage assembly coupled between the torque restraint and motor. Torque is delivered to the pipe string by operating the motor and a measurement is made of the strain in the linkage assembly imposed by reacting the torque to the rail position. The torque generated by the top drive assembly is estimated based on the strain measured in the linkage assembly. In an embodiment, the linkage assembly includes a clevis hinge mounted to a housing around the motor, a linkage member pivotingly coupled to the torque restraint, and a pin coupling the clevis hinge to the linkage member. In an example embodiment, the measured strain in the pin results from a bending moment created by the torque. In one example embodiment, the pin is oriented along a line substantially perpendicular to the pipe string. Optionally, the linkage assembly can include additional clevis hinges mounted to the housing along with additional linkage members and additional pins coupling the additional clevis hinges to the additional linkage members. The strain in one or more of the additional pins can also be measured. Alternatively, the pins being measured for strain are generally coaxial to one another and disposed on opposing lateral sides of the torque restraint; the pins being measured for strain may be set a distance apart from one another along a length of the top drive assembly.

Also disclosed herein is a top drive assembly for use with a drilling rig. In an example embodiment the top drive assembly has a motor selectively connectable to a pipe string, a restraint slideable along a rail extending vertically along a mast of the drilling rig, a linkage assembly coupled between the restraint and motor, and a strain gauge for measuring strain in the linkage assembly, so that when the torque generated by the motor is transferred to the restraint and the rail through the linkage assembly, the gauge can be used to measure the torque. In one example embodiment, the linkage assembly is made up of a clevis hinge mounted to a housing around the motor, a linkage member with an end pivotingly coupled to the restraint. A pin can be used for coupling the clevis hinge to the end of the linkage member distal from the end coupled to the torque restraint, wherein the gauge is disposed on the pin. Alternatively, the pin is oriented along a line substantially perpendicular to the drill string. In another optional embodiment, the linkage assembly further includes additional clevis hinges mounted to the housing along with additional linkage members and additional pins coupling the additional clevis hinges to the ends of the additional linkage members distal from the ends coupled to the torque restraint. Additional gauges may be included on one or more of the additional pins. The pins being measured for strain may be generally coaxial to one another and disposed on opposing lateral sides of the torque restraint and can be set as distance apart from one another along a length of the top drive assembly.

Yet further described herein is a drilling rig for forming a subterranean borehole. In an example embodiment the drilling rig includes a rail vertically disposed on a mast of the rig, and a top drive coupled to and selectively moveable along the length of the rail. The top drive is made up of a motor for rotating a pipe string, linkage members linked between the top drive and rail, pins in opposing ends of the linkage members, so that torque generated by the motor is transferred through the linkage members and the pins to the rail, and a strain gauge set on at least one of the pins for measuring strain in the pin for estimating a torque generated by the motor. The linkage members can be linked to the rail by a torque restraint that is slideable along the length of the rail. In an example embodiment, the linkage members are elongate and define a linkage for articulating the top chive away from the rail. Additional linkage members may be included that are linked together by additional pins. Yet further optionally, additional strain gauges can be provided that are disposed on one of the additional pins.

DETAILED DESCRIPTION OF THE INVENTION

Figure 1:
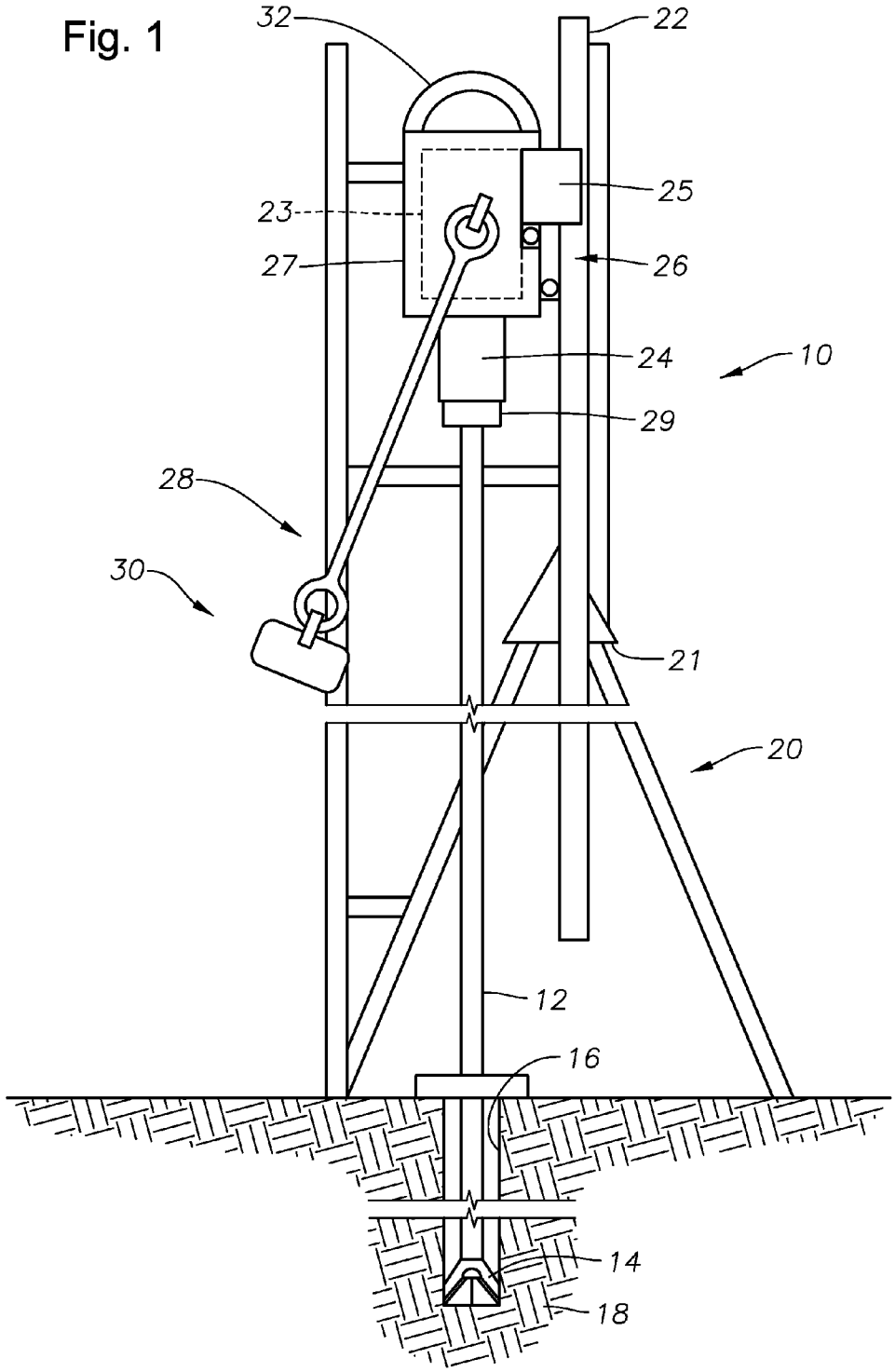
FIG. 1 is a schematic partial sectional view illustrating a top drive in a rig forming a borehole.

An example embodiment of a top drive assembly 10 is shown in a side partial sectional view in FIG. 1. The top drive assembly 10 of FIG. 1 is used for rotating a pipe string 12 shown having a hit 14 on its lower end. The pipe string 12 could be drill pipe, which is retrieved after drilling a well. Alternatively, the pipe string 12 could be casing for drilling and casing the well. Also, pipe string 12 could be casing being run into a previously drilled well. Rotating the bit 14 with a sufficient downward force forms a borehole 16 through the formation 18 below the top drive assembly 10. In the example embodiment of FIG. 1, the top drive assembly 10 is mounted within a drilling rig 20 and the pipe string 12 is made of casing being used to drill the well, after which the casing can be cemented into place. As shown, the drilling rig 20 includes a frame 21 made up of support members and a generally vertically oriented rail 22 that is mounted within the frame 21. A motor 23, shown in a dashed outline within a housing 27, mechanically couples to a quill 24 that drives the pipe string 12. As is known, the rotation of the motor 23 and combined with torsional forces in the pipe string 12 during drilling, exert a resultant torque onto the top drive assembly 10 that is transferred to the drilling rig 20 via coupling between the top drive assembly 10 and the frame 21. A casing gripper 29 is secured to quill 24 for gripping the pipe string 12.

In the example of FIG. 1, the top drive assembly 10 is coupled to the drilling rig 20 by a torque restraint 25 that slidingly mounts on the rail 22; thus allowing vertical movement of the top drive assembly 10 within the drilling rig 20. A linkage 26 couples the housing 27 of the top drive assembly 10 to the torque restraint 25. The linkage 26, which is made up of elongate members connected with pivoting ends, may allow some articulated movement of the top drive assembly 10 away from die rail 22 for retrieving pipe segments to incorporate into the pipe string 12.

Further illustrated in the example of FIG. 1 is a bail assembly 28 pivotingly mounted to casing gripper 29. Alternatively, bail assembly 28 could be mounted to housing 27 and have an attached elevator 30. The elevator 30, in one embodiment, includes clamps that may be power driven for grappling and retaining pipe segments (not shown) for integration into the pipe string 12.

Figure 2:
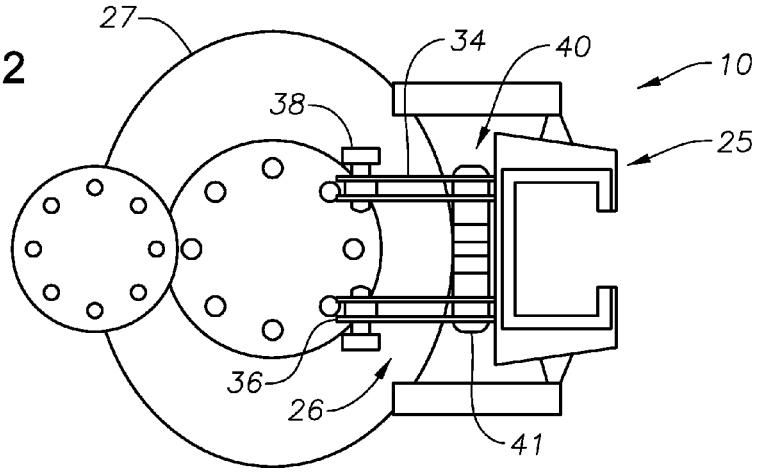
FIG. 2 is an overhead view of a top drive.

Provided in FIG. 2 is an overhead embodiment of a top drive assembly 10 and illustrating the rectangular inner periphery of the torque restraint 25 that is configured for mounting around the rail 22 (FIG. 1). Further illustrated in FIG. 2 are components of the linkage assembly 26, shown as clevis hinges 34 attached on the side of the torque restraint 25 facing the motor housing 27. Each clevis hinge 34 is made up of a pair of generally planar vertically oriented members. Edges of the clevis hinges 34 attach to the side of the torque restraint 25 facing the motor housing 27; free ends of the clevis hinges 34 located opposite the attached edge have a lateral bore formed therethrough. The members of each clevis hinge 34 define an open space therebetween. Linkage members 36 are shown inserted between the open space, where the linkage members 36 have a corresponding bore registered with the bores through the clevis hinges 34.

Pins 38 insert through the registered bores of each clevis hinge 34 and elongate member 36 to pivotingly couple the linkage members 36 to the clevis hinges 34. The linkage members 36 have lower ends similarly pivotingly coupled with a portion of the top drive assembly 10 so that the top drive assembly 10 can selectively articulate away from and back towards the torque restraint 25. Below the clevis hinge 34 is another clevis hinge assembly 40 shown set between the torque restraint 25 and motor housing 27. An elongate member 41 is pivotingly coupled on one end to the clevis hinge 40, and connected on a lower end (not shown) to the top drive assembly 10 for providing additional linkage connection between the top drive assembly 10 and torque restraint 25.

Figure 3:
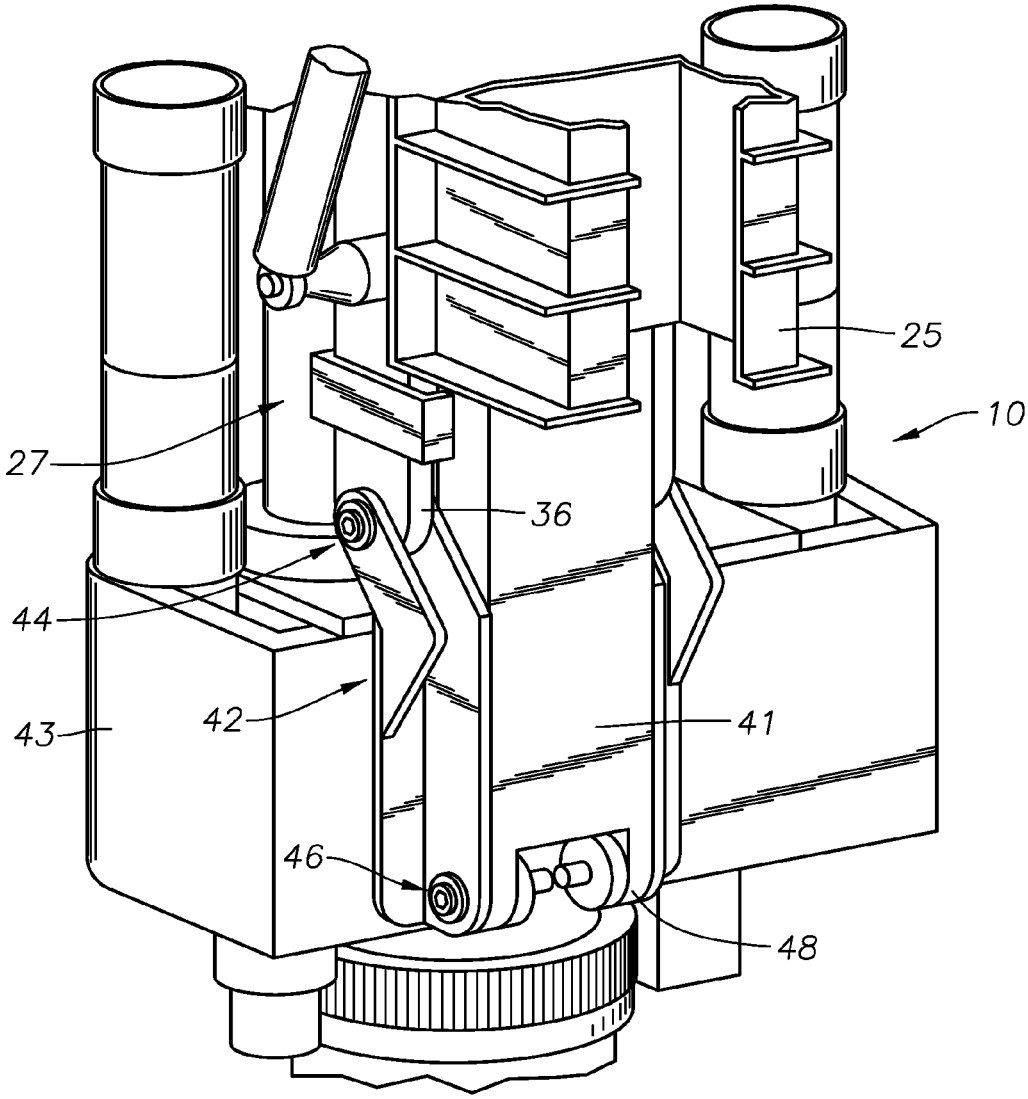
FIG. 3 is a perspective view of a linkage for coupling a torque restraint to a top drive.

Referring now to FIG. 3, a rear perspective view of an example of a top drive assembly 10 is shown in a perspective view. In this example embodiment, the motor housing 27 is disposed proximate to the torque restraint 25. Also shown in FIG. 3 is the lower pivoting connection of the elongate member 41. A pair of clevis hinges 42 are shown mounted on a side surface of the motor housing 27 and set a lateral distance apart on opposing lateral sides of the elongate member 41. In the example embodiment of FIG. 3, the clevis hinges 42 each have an upper portion with an outer side wall that slopes away from the motor housing 27, defines a peak, then slopes back towards the motor housing 27 and terminates at a location between the upper and lower ends of the clevis hinges 42. An inner side wall on the clevis hinges 42, disposed adjacent the elongate member 41, projects outward and parallel with the outer sidewall, but extends substantially the entire length of each of the clevis hinges 42. Bores are formed through the inner and outer side walls of the clevis hinges 42 at their respective upper and lower ends. Bores are also provided in the lower ends of the linkage members 36 that register with the bores in the upper ends of the clevis hinges 42. Pins 44 are inserted through the registered bores in the lower end of linkage member 36 and upper ends of the clevis hinges 42 thereby pivotingly coupling the linkage member 36 with the clevis hinge 42.

Because the outer side wall terminates above the lower end of the clevis hinges 42, the bores in the lower end of the clevis hinges pass only through the inner side wall. The bores in the lower ends of the clevis hinges 42 register with bores formed laterally through lower depending legs 48 shown on the elongate member 41. Pins 46 project through the registered bores in the respective lower ends of the clevis hinges 42 and the lower depending legs 48 from the elongate member 41. Thus, strategically providing the bores for insertion of the pins 44, 46 enables articulated movement of the main body of the top drive assembly 10 from the torque restraint 25 by pivoting of the linkage members 36, 41.

Figure 4:
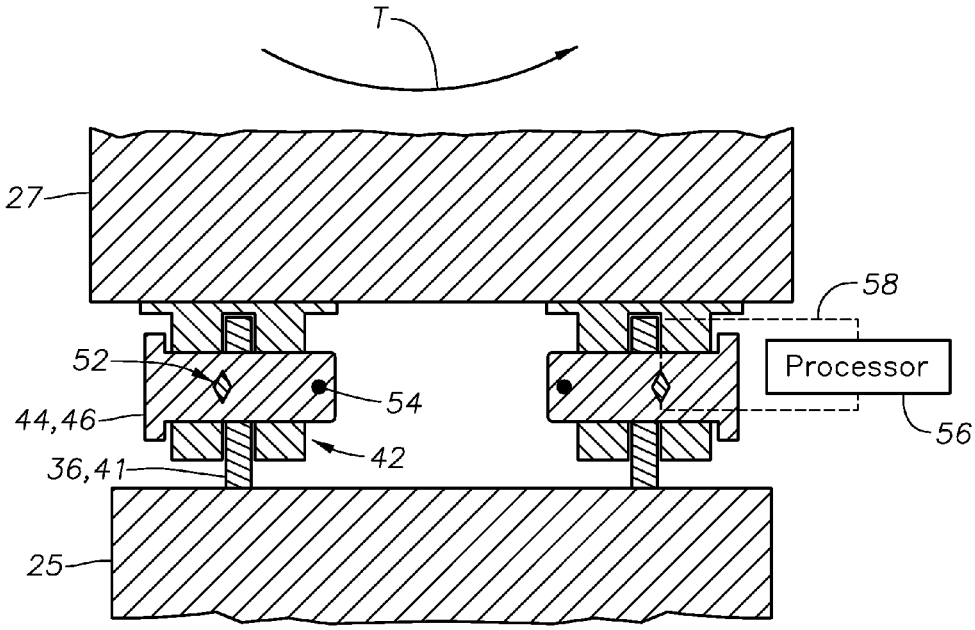
FIG. 4 is a partial sectional view of a linkage for coupling a torque restraint to a top drive.

Schematically illustrated in FIG. 4 is a partial sectional view of the coupling between the torque restraint 25 and motor housing 27 by the clevis hinges 42. In optional embodiments, the coupling of FIG. 4 represents the connection between the clevis hinges 42 and the members 36 or member 41 respectively by pins 44, 46. Further illustrated in FIG. 4 are strain gauges 52 for measuring strain within the pins 44, 46. Optional bores 54 are shown through the pins 44, 46 through which a counter pin or other lynch type pin (not shown) is inserted to retain the pins 44, 46 within the pivoting coupling. The strain gauges 52 measure strain through bending moment in the pins 44, 46 and can thereby provide a measurement of torque, represented by the curved arrow T, from the motor 23 (FIG. 1). The use of a strain gauge 52, rather than the known ways of measuring amperage and/or a torque sub, not only increases accuracy and repeatability, but provides a quicker response so that adjustments in motor controls can be more quickly made during drilling operations.

To facilitate control of the systems, a processor 56 is shown coupled with the strain gauge 52 by a communication link 58, such as a hard wire or telemetry communication. In an example embodiment, the processor 56 receives a signal from the strain gauge 52 via the communication link 58 and converts the signal into a correlative torque value. The signal typically is a voltage that changes in response to the strain imposed on the strain gauges 52. Optionally, the processor 56 sends a command to adjust operation of the motor 23 based on the signal received from the communication link 58 and/or the converted torque value. The command can be transmitted directly to the motor 23 or to an optional motor controller (not shown).

While the invention has been shown in only one of its forms, it should be apparent to those skilled in the art that it is not so limited thus susceptible to various changes without departing from the scope of the invention.

The invention claimed is:

1. A method of estimating torque generated by a top drive assembly while forming a wellbore, comprising:

a. providing a top drive assembly having a motor for rotating a pipe, a torque restraint engageable with a rail portion of a drilling rig, and a linkage assembly coupled between the torque restraint and motor, wherein the linkage assembly comprises:

i. a clevis hinge mounted to a housing around the motor;

ii. a linkage member pivotingly coupled to the torque restraint; and iii. a pin coupling the clevis hinge to the linkage member;

b. delivering torque to the pipe string by operating the motor;

c. measuring strain in the pin imposed by reacting the torque to the rail portion, and wherein the strain in the pin is due to a bending, moment created by the torque; and d. estimating the torque generated by the top drive assembly based on the strain measured in the pin.

2. The method of claim 1, wherein the pin is oriented along a line substantially perpendicular to the pipe string.

3. The method of claim 1, wherein the linkage assembly further comprises additional clevis hinges mounted to the housing, additional linkage members, each with an end pivotingly coupled to the torque restraint, and additional pins coupling the additional clevis hinges to the additional linkage members.

4. The method of claim 3, further comprising measuring strain in at least one of the additional pins.

5. The method of claim 4, wherein the pins being measured for strain are generally coaxial to one another and disposed on opposing lateral sides of the torque restraint.

6. The method of claim 4, wherein the pins being measured for strain are set a distance apart from one another along a length of the top drive assembly.

7. A top drive assembly for use with a drilling rig comprising:

a motor selectively connectable to a pipe string;

a restraint slideable along a rail extending vertically along a mast of the drilling rig;

a linkage assembly coupled between the restraint and motor, the linkage comprising a clevis hinge mounted to a housing around the motor, a linkage member with an end pivotingly coupled to the restraint, and a pin coupling the clevis hinge to the end the linkage member distal from the end coupled to the torque restraint; and a strain gauze disposed on the pin for measuring strain in the linkage assembly, so that when the torque generated by the motor is transferred to the restraint and the rail through the linkage assembly, the strain gauge can be used to measure the torque.

8. The top drive of claim 7, wherein the pin is oriented along a line substantially perpendicular to the drill string.

9. The top drive of claim 7, wherein the linkage assembly further comprises additional clevis hinges mounted to the housing, additional linkage members, each with an end pivotingly coupled to the torque restraint, and additional pins coupling the additional clevis hinges to the ends of the additional linkage members distal from the ends coupled to the torque restraint.

10. The top drive of claim 9, further comprising additional gauges on at least one of the additional pins.

11. The top drive of claim 10, wherein the pins being measured for strain are generally coaxial to one another and disposed on opposing lateral sides of the torque restraint.

12. The top drive of claim 10, wherein the pins being measured for strain are set a distance apart from one another along a length of the top drive assembly.

13. A drilling rig for forming a subterranean borehole comprising:

a rail vertically disposed on a mast of the rig;

a top drive coupled to and selectively moveable along the length of the rail and comprising:

a motor for rotating a pipe string, linkage members linked between the top drive and rail, pins in opposing ends of the linkage members, so that torque generated by the motor is transferred through the linkage members and the pins to the rail; and a strain gauge set on at least one of the pins for measuring strain in the pin for estimating a torque generated by the motor.

14. The drilling rig of claim 13, wherein the linkage members are linked to the rail by a torque restraint that is slideable along the length of the rail, and the linkage members are elongate and define a linkage for articulating the top drive away from the rail.

15. The drilling rig of claim 13, further comprising additional linkage members linked together by additional pins.

16. The drilling rig of claim 15, further comprising another strain gauge on one of the additional pins.

* * * * *